United States Patent [19]

Di Giovanni et al.

[11] 4,302,012

[45] Nov. 24, 1981

[54] ROTARY GAMEBOARD WITH REMOVABLE COMPARTMENTS

[76] Inventors: Augustine Di Giovanni; Gloria Di Giovanni, both of 98 Union Ave., Amityville, N.Y. 11701

[21] Appl. No.: 124,304

[22] Filed: Feb. 25, 1980

[51] Int. Cl.[3] ..... A63F 1/06

[52] U.S. Cl. ..... 273/148 R; 131/238

[58] Field of Search ..... 273/148 R, 148 A, 280; 131/238

[56] References Cited

U.S. PATENT DOCUMENTS

| | | | |
|---|---|---|---|
| 2,008,829 | 7/1935 | Israel | 273/148 A |
| 2,188,692 | 1/1940 | Schultz | 131/238 X |
| 2,400,610 | 5/1946 | Skinner | 131/238 X |
| 3,011,789 | 12/1961 | Eliassen et al. | 273/148 R X |

OTHER PUBLICATIONS

Revolving Game Board Advertisement, Parade Magazine, Dec. 21, 1969, p. 10.

*Primary Examiner*—Anton O. Oechsle
*Attorney, Agent, or Firm*—Richard L. Miller

[57] ABSTRACT

A game comprising a gameboard having a stationary pedestal adapted for placement on a support surface. A circular platform having a playing surface on one side thereof is capable of rotation with respect to the stationary pedestal. A plurality of compartments are formed into the playing surface for receiving said playing chips therein.

1 Claim, 3 Drawing Figures

Fig. 1
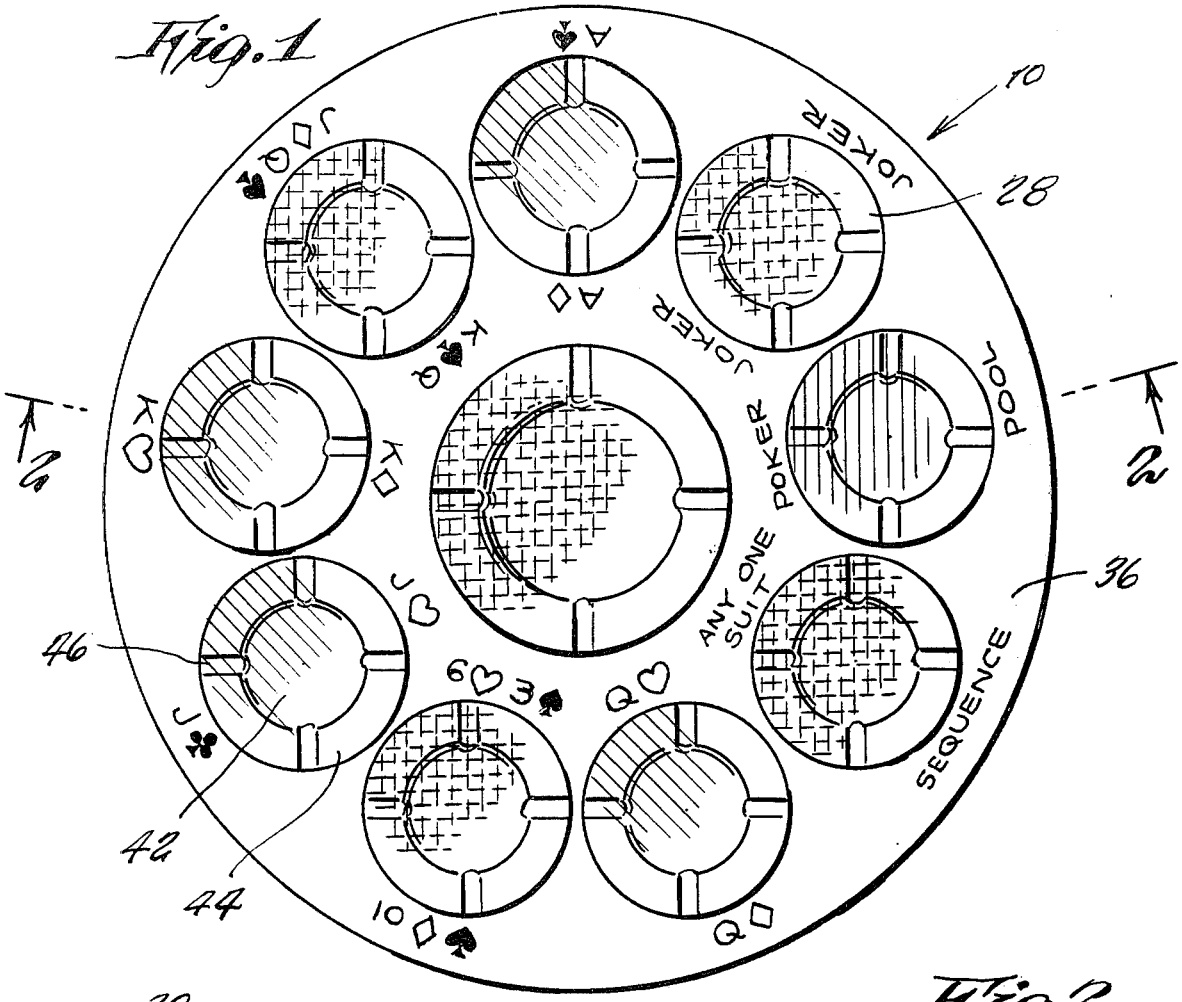
Fig. 2
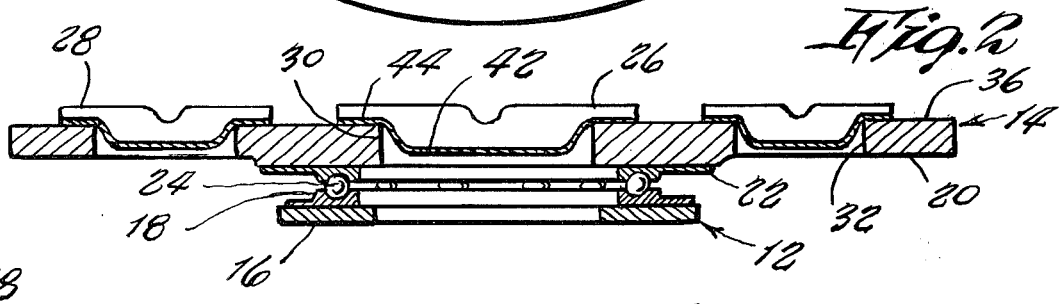
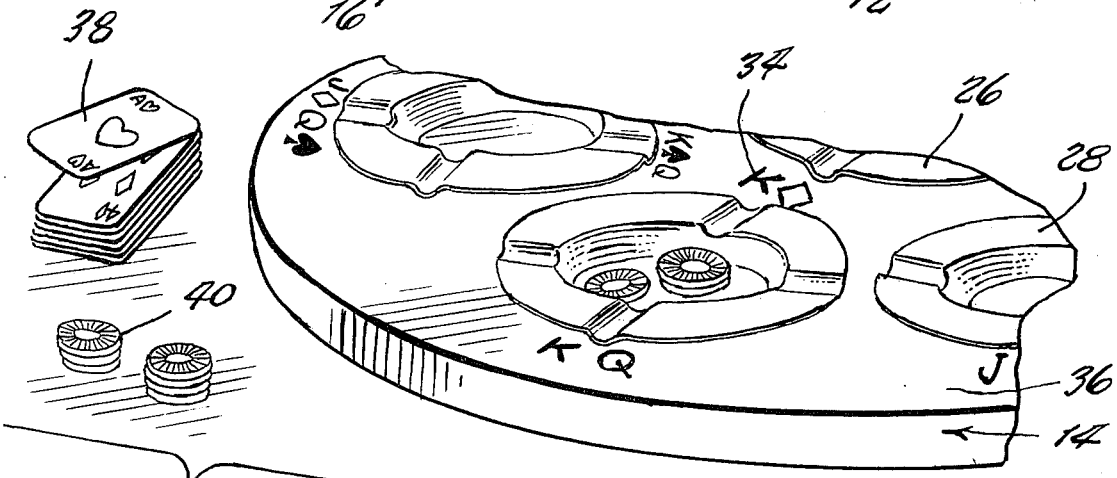
Fig. 3

ROTARY GAMEBOARD WITH REMOVABLE COMPARTMENTS

BACKGROUND OF THE INVENTION

This invention relates to games and more particularly to a rotating gameboard for use with card games.

There are numerous card games which require a gameboard in conjunction with the card game, and frequently including playing chips. By way of example, one of the many famous card games requiring a gameboard is the game of Michigan Rummy. This game has numerous variations such as Rummy Royal, playing the poker hand, and numerous other variations. There are also many other games all utilizing the same basic requirements.

With such games, in addition to the set of playing cards and playing chips, the gameboard is somewhat standard in that it has a central pot with numerous peripheral playing sections about the central pot. The chips are generally placed in each of these playing sections as well as the pot and by means of the appropriate cards, players can win playing chips from selected ones of the playing sections of the gameboard.

One of the problems with this type of gameboard, is that frequently many players are playing the game, often as many as eight players. As a result, the size of the gameboard is frequently quite large and as a result, players on one side of the board have difficulty reaching over to the sections on the other side of the board. The gameboards are often formed out of paper or vinyl with the various playing sections printed thereon. As a result, the size of the gameboard can be made large to accommodate all of the players sitting around the board. However, when a player from one side has to reach over to take some playing chips from an opposite side, it becomes most awkward, inconvenient, and disturbing to the playing of the game. Of course, one player can bother an opposing player and have him take the chips, but again this disturbs the concentration of the other player, causes continuous bother between the players, which again provides an annoyance to the enjoyment to the game.

One way of alleviating this problem is to have the gameboard turn. When the gameboard is made out of paper of plastic, this becomes difficult because the board is extremely flimsy and flexible and can tilt during rotation thereof from one position to the other, causing the playing chips to fall from one playing section to another playing section. An alternative is to make the gameboard out of a solid plastic material whereby the whole board can be picked up and rotated. However, this also provides difficulty since in the course of rotation, as the board is lifted up off the support surface to rotate it, the chips can fall out or pass from one section to the next section.

SUMMARY OF THE INVENTION

It is an object of the present invention to provide a gameboard which avoids the aforementioned problems of prior art devices.

Yet another object of the present invention is to provide a gameboard which can be easily rotated to bring each part of the gameboard in front of a player.

A further object of the present invention is to provide a game having a rotating gameboard in conjunction with a deck of cards and playing chips.

Yet a further object of the present invention is to provide a gameboard having a fixed pedestal and a rotating platform, the platform serving as the playing surface and having a plurality of compartments therein.

A further object of the present invention is to provide a rotating gameboard having a plurality of compartments which can be used to receive playing chips during certain games, and which can also be utilized as ashtrays when not being used as part of a game.

Still another object of the present invention is to provide a rotating gameboard which can be used with cardgames such as Michigan Rummy.

Yet a further object of the present invention is to provide a rotating gameboard which can be utilized with various card games.

Another object of the present invention is to provide a rotating gameboard which is simple in construction, easy to utilize, sturdy, and inexpensive to manufacture.

Briefly, in accordance with the present invention, there is provided a game having a gameboard with a fixed stationary pedestal adapted for placement on a support surface. A circular platform has a playing surface on one side thereof and can circularly rotate with respect to the pedestal. A plurality of compartments are formed into the playing surface for receiving playing chips.

In an embodiment of the invention, there is a centrally located compartment with equally spaced apart satellite compartments peripherally located around the central compartment and lying in a common concentric circle. By forming the compartments as circular ashtrays, and forming holes in the platform to receive these ashtrays, the gameboard can also be utilized as a series of ashtrays for players involved in various games, such as cardgames which do not require the utilization of the gameboard.

The aforementioned and other objects, features and advantages of the invention will, in part, be pointed out with particularity, and will, in part, become obvious from the following more detailed description of the invention, taken in conjunction with the accompanying drawing, which forms an integral part thereof.

BRIEF DESCRIPTION OF THE DRAWING

In the drawing:

FIG. 1 is a top view of the gameboard in accordance with the present invention;

FIG. 2 is a sectional elevational view taken along line 2—2 of FIG. 1, and FIG. 3 is an exploded view of the various parts of the game including the gameboard, a deck of playing cards, and playing chips.

In the various figures of the drawing, like reference characters designate like parts.

DESCRIPTION OF THE PREFERRED EMBODIMENT

Referring now to the drawings, the present invention includes a gameboard shown generally at 10 and formed of a fixed pedestal 12 and a circular platform 14. The fixed pedestal has a lower surface 16 which is substantially flat and can be placed upon a support surface. The pedestal includes an upper annular section 18. Located on the underside 20 of the platform is a corresponding annular section 22. The two annular sections 18, 22 contain cooperating recesses for receiving a set of ball bearings 24 for thereby permitting circular rotation of the platform 14 with respect to the pedestal 12.

The platform includes a central compartment 26 with a plurality of satellite compartments 28 located peripherally about the central compartment. The satellite compartments 28 are equally spaced apart and are substantially identical to each other. They are all formed about a concentric circle around the central compartment 26. The central compartment 26 is shown to be larger than the satellite compartments 28.

Each of the compartments are formed of a separate tray which is inserted into a hole within the platform. Specifically, the hole 30 is formed centrally of the platform and receives the central compartment 26 while the holes 32 are formed peripherally about the central hole and each respectively receive a satellite compartment 28.

Indicia 34 are provided on the playing surface 36 of the platform 14 for identifying each of the compartments. For example, one of the satellite compartments is identified by the indicia "poker pool" while others are identified by specific designations representing specific cards of a deck of playing cards, such as the queen of hearts, etc.

In addition to the gameboard, there is also provided in the game a deck of playing cards 38, and a number of playing chips 40. The chips are of a size so that they can fit within the compartments, as best shown in FIG. 3.

The gameboard in conjunction with the cards and the playing chips can be utilized with many different types of cardgames. For example, it can be utilized in conjunction with the game of Michigan Rummy. With this game, each player is given an equal number of chips. The chips are bet on each of the various compartments. The deck of playing cards are dealt one at a time to each player including an extra hand. Usually, the dealer has the choice of his hand or the extra hand. Should the dealer not want the extra hand he can auction it to the highest bidder.

The dealer then lays down in front of him face up, the lowest card in his hand, calling it by name. The player who holds the next highest consecutive card in the same suit places it in front of him. This continues until the Ace of the suit is played or until the highest card held by any player in that suit is played. The player who plays the stop card, or highest card, must change suits by playing the lowest card in any other suit in his hand. If a player cannot change suits, the player to his left must do so. The first player who discards all of his cards wins the chips in the poker pool compartment. The other players pay the winner one chip for each card left in their hand.

Specific chips from selected ones of the compartments can be done at the beginning whereby holders of specific ones of the cards corresponding to designations on the gameboard can take chips from those sections. Alternately, other variations can be utilized for awarding the playing chips to the various players.

Usually, with these types of card games, anywhere from 2 to 8 players are involved. Utilizing the gameboard of the present invention, the 8 players can suitably be positioned about the gameboard. Each player can easily reach into the compartments in front of him to either place the chips in the appropriate compartment, or alternately, remove chips therefrom as he wins the chips. With the present gameboard, even if the chips which he wins are in a compartment directly opposite from where he is sitting, all he need do is rotate the platform of the gameboard about its pedestal until the suitable compartment reaches in front of him and he can then extract the playing chips from the desired compartment. In this manner, he need not reach across the gameboard and disturb the other players, nor does he have to bother a player to extract the playing chips for him. Each player in turn can simply rotate the platform as needed to place the desired compartment in front of him.

By making the various compartments out of ashtrays, an extra convenience is obtained. Specifically, it is noted that each of the compartments is an ashtray including a central cup-shaped section 42 with a laterally extending peripheral flange 44 in which there are a number of grooves 46 to accommodate the placements of cigarettes therein. By making the compartments ashtrays, the present gameboard serves as an additional function purpose. Specifically, when the gameboard is not necessarily involved in a particular game such as regular poker, the players may still be seated around the gameboard. Normally, many of the players may smoke cigarettes during the course of a card game. They would normally require ashtrays to be placed around the table where they are sitting. Since the present gameboard is already situated in front of the players for use during certain ones of the card games, during those card games in which they do not require the gameboard, they can utilize the compartments as ashtrays.

By making the platform and pedestal out of wood with the various ashtrays out of metal, the gameboard will be sturdy, durable, and will last for a considerably long period of time. The particular size of the gameboard can be varied depending upon the number of players, the size of the table on which it is to be used, etc.

There has been disclosed heretofore the best embodiment of the invention presently contemplated. However, it is to be understood various changes and modifications may be made thereto without departing from the spirit of the invention.

We claim:

1. A game comprising a gameboard having a stationary pedestal adapted for placement on a support surface; a solid circular platform having a playing surface on one side thereof; a central circular hole formed entirely through said platform, and spaced apart uniform satellite holes smaller than said central hole, peripherally located around said central circular hole, lying on a concentric circle and also formed entirely through said platform; a central compartment removably received in said central hole and a plurality of uniform satellite compartments respectively received in said satellite holes, said compartments extending downward only part way into their respective holes; said pedestal having an upper portion which is larger than said central hole and smaller than said concentric circle so as to support said platform thereabout, said upper portion being an upwardly extending annular ring having a circular recess formed therein on the uppermost surface thereof; said platform having a bottom portion, said bottom portion being larger than said central hole and smaller than said concentric circle and being a downwardly extending annular ring having a circular recess formed therein on the lowermost surface thereof; a set of ball bearings positioned between said upper portion of said pedestal and said bottom portion of said platform, said set of ball bearings being received in said recesses of said upper and bottom portions so that said platform may rotate relative to said pedestal; each of said plurality of satellite compartments having a central cup section and a lateral peripheral flange formed about the upper edge thereof, said flange resting upon the top playing surface of said platform and said central cup section extending downwardly into a respective one of said satellite holes, said flange having at least one groove formed therein on the top surface thereof for receiving a cigarette, said central cup and flange being removably mounted in its respective satellite hole, whereby the platform and its playing surface may be rotated by a player or players for easy access to a particular one of the satellite compartments.

* * * * *